US005975856A

United States Patent [19]

Welle

[11] Patent Number: 5,975,856

[45] Date of Patent: Nov. 2, 1999

[54] METHOD OF PUMPING A FLUID THROUGH A MICROMECHANICAL VALVE HAVING N-TYPE AND P-TYPE THERMOELECTRIC ELEMENTS FOR HEATING AND COOLING A FLUID BETWEEN AN INLET AND AN OUTLET

[75] Inventor: Richard P. Welle, Huntington Beach, Calif.

[73] Assignee: The Aerospace Corporation, El Segundo, Calif.

[21] Appl. No.: 08/944,526

[22] Filed: Oct. 6, 1997

[51] Int. Cl.[6] ..... F04B 19/24

[52] U.S. Cl. ..... 417/53; 62/3.3

[58] Field of Search ..... 417/53, 52, 410.1, 417/411; 137/341, 13, 251.1, 828; 62/3.3; 251/129.01

[56] References Cited

U.S. PATENT DOCUMENTS 2,910,836 11/1959 Karrer ..... 62/3
2,928,253 3/1960 Lopp et al. ..... 62/3
3,111,813 11/1963 Blumentritt ..... 62/3
3,197,342 7/1965 Neild, Jr. ..... 136/4
3,779,814 12/1973 Miles et al. ..... 136/236.1
4,476,685 10/1984 Aid ..... 62/3.3
4,989,626 2/1991 Takagi et al. ..... 137/13

*Primary Examiner*—Charles G. Freay
*Assistant Examiner*—Robert Z. Evora
*Attorney, Agent, or Firm*—Derrick Michael Reid

[57] ABSTRACT

A pumping method is used for pumping a fluid from an inlet to an outlet of a pump having a plurality of micromechanical valves. Each micromechanical valve is for communicating a fluid and constructed from n-type and p-type materials forming a peltier junction interface which can be selectively cooled to freeze the fluid into a plug to obstruct the flow of fluid, or selectively heated to melt the plug to communicate the fluid in a tube extending through the junctions. A plurality of valves connected in series can be used together as a pump to pump the fluid from the inlet through the valves to the outlet. Selective heating and cooling of the junctions provides varying fluid pressures and plugs along the tube to pump the fluid through the tube.

6 Claims, 3 Drawing Sheets

METHOD OF PUMPING A FLUID THROUGH A MICROMECHANICAL VALVE HAVING N-TYPE AND P-TYPE THERMOELECTRIC ELEMENTS FOR HEATING AND COOLING A FLUID BETWEEN AN INLET AND AN OUTLET

REFERENCE TO RELATED APPLICATION

The present application is related to applicant's copending application entitled Micromechanical Valve and Pump, Ser. No. 08/944,525, filed Oct. 6, 1997, in the name of the same inventor.

STATEMENT OF GOVERNMENT INTEREST

The invention was made with Government support under Contract No. F04701-93-C-0094 by the Department of the Air Force. The Government has certain rights in the invention. The invention described herein may be manufactured and used by and for the government of the United States for governmental purpose without payment of royalty therefor.

FIELD OF THE INVENTION

The invention relates to the field of micromechanical devices. More specifically, the present invention relates to miniaturized electro micromechanical valves and pumps to communicate fluids.

BACKGROUND OF THE INVENTION

Micromechanical systems have been evolving based on applying microelectronic processing and production techniques for microscopic mechanical systems such as gears, motors, diaphragms and levers. Microscopic mechanical systems have been used as sensors for sensing acceleration, pressure, and chemical composition, and have been used as actuators such as moving mirrors, shutters, and aerodynamic control surfaces. More particularly, micromechanical systems have been proposed for use in fluid control, such as in medical pharmaceuticals, bearing lubricators and miniature space systems. Many types of fluid flow control systems require the use of pumps and valves.

Micromechanical pumps are miniature versions of standard size pumps which operate by opening and closing valves in an appropriate sequence while changing the volume between the valves to move fluid through the valves. The valves function to obstruct the path of a communicating fluid. For example, a silicon diaphragm is pushed against a silicon orifice to block the communication of fluid through the orifice. Sealing around the orifice to perfect the obstruction is disadvantageously unreliable because the sealing area is relatively very small as compared to macromechanical systems and because minor imperfections in the sealing surface will lead to leak rates which are negligible at the macroscopic level but significant in comparison to the total fluid flow at the microscopic level. Elastomeric materials have been used for improved valve sealing but are difficult to manufacture on a micromechanical seal. The reliability of micromechanical valves is disadvantageously limited by leakage of the valves on a micro scale. Micromechanical valves and pumps also disadvantageously use moving parts to change the volume of the pumps and suffer from long term reliability problems of moving parts. These and other disadvantages are solved or reduced using the invention.

SUMMARY OF THE INVENTION

An object of the invention is to provide a micromechanical valve for controlling a communicating fluid.

Another object of the invention is to provide a micromechanical valve using a peltier junction to freeze a plug of a communicating fluid to obstruct fluid flow.

Another object of the invention is to provide micromechanical pumps using micromechanical valves.

Another object of the invention is to provide micromechanical pumps having a plurality of peltier junction micromechanical valves.

Another object of the invention is to provide a method of pumping fluid through a pump having a plurality of micromechanical valves having peltier actuated junctions.

A peltier actuated micromechanical valve comprises a tube having a peltier junction for freezing a plug of the fluid communicating through the tube at the junction. The plug is an obstruction to fluid flow in the tube when frozen. The plug can be then be heated at the junction to melt the plug of fluid to unblock fluid flow. The peltier junction is the junction between two different metals, an n-type metal and a p-type metal, for conducting current in two directions across the junction, in a forward direction for cooling the junction when electrical current flows from the n-type metal to the p-type metal, or in a reverse direction for heating the junction when electrical current flows in the opposite direction, from the p-type metal to the n-type metal. In the simplest form, an n-type metal and a p-type metal buttress each other and form a junction at the p-type to n-type metal interface. A tube, such as a drilled hole through the interface of the two metals, communicates the fluid through the junction. Electrical contacts to the two types of metal provide for current flow in two different directions for active cooling or heating. When no current conducts through a junction, a frozen plug is heated or heated fluid is cooled to an ambient temperature through passive termal conduction which can be used for fluid pumping.

A micromechanical pump comprises a plurality of peltier actuated micromechanical valves, for example, three valves of three aligned junctions formed by a series of four alternating metal blocks, n-type, p-type, n-type, and p-type, having a common tube for controlled pumping of the fluid in the fluid communicating tube. The junctions can be selectively actively or passively cooled or heated through the peltier effect by connecting and controlling electrical contacts for conducting electric current through the junctions to selectively cool or heat fluid at the junctions. A sequence of cooling and heating steps of the junctions enables a pumping action by expanding and contracting fluid in the tube connecting the exemplar first, second, and third junctions. For example, an exemplar sequence begins with the first junction cooled to freeze a plug at that junction to confine fluid flow, then the second junction is cooled to contract the fluid in that junction and draw fluid into the pump through the third junction, then the third junction is cooled to freeze a plug at that junction, then the first junction is heated to melt the plug at that junction, then the second junction is heated to expand the fluid, forcing it through the first junction and out of the pump, then the first junction is cooled to reform the plug at that junction, and finally, the third junction is heated to melt the plug at that junction. By this process, the sequence has returned to its starting point with a net volume of fluid having been moved through the pump. The pump has no moving parts subject to wear nor seals subject to leakage at the junctions used for freezing plugs of frozen fluid. These and other advantages will become more apparent from the following detailed description of the preferred embodiment.

DETAILED DESCRIPTION OF THE PREFERRED EMBODIMENT

Figure 1:
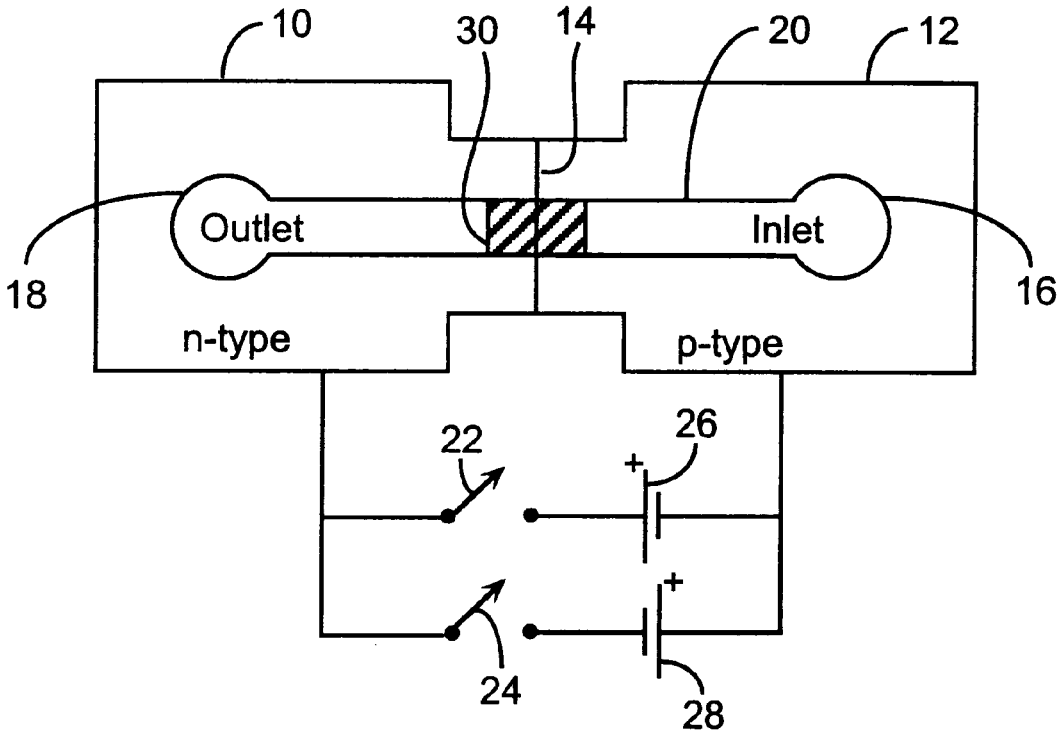
FIG. 1 is a valve switching schematic.

An embodiment of the invention is described with reference to the figures using reference designations as shown in the figures. Referring to FIG. 1, a micromechanical valve is shown comprising an n-type metal block 10 and a p-type metal block 12. The junction 14 is an interface between the two metal blocks 10 and 12. Block 12 has an inlet 16 and block 10 has an outlet 18 between which is extending a tube 20. A fluid is communicated between the inlet 16, through the tube 20 to the outlet 18. The two blocks 10 and 12 may be heat fused together and the tube 20 may be drilled through the two blocks 10 and 12 to form the junction 14 around the tube 20 without the need for sealing the blocks 10 and 12 at the junction 14. The junction 14 has at least one switch and at least one source of electrical power, for example, two switches 22 and 24 for providing current through the blocks 10 and 12 from a power supply, such as two batteries 26 and 28. The switches 22 and 24, and the batteries 26 and 28 are respectively used to freeze and melt a plug 30. The plug 30 at the junction 14 is a frozen portion of the communicating fluid. When switch 22 is closed, electrical current conducts from the battery 26, through the switch 22, to the n-type block 10 through the peltier junction 14 in a forward direction, to the p-type block 12, back to the battery 16, to cool the junction 14 to create the plug 30. When switch 24 is closed, electrical current conducts from the battery 28, to the p-type block 12 through the peltier junction 14 in a reverse direction, to the n-type block 10, through the switch 24 and back to the battery 16, to heat the junction 14 to melt the plug 30 so that the fluid can flow. When neither heating nor cooling the junction 14, plug 30 may melt through thermal conduction through the metal blocks 10 and 12, and the active heating of the junction 14 using switch 14 may then not be necessary to melt the plug 30.

In an exemplar form, a valve may be formed by joining two blocks 10 and 12 of bismuth telluride, one n-type and one p-type. Each block can be approximately cubic with dimensions of 2×2×2 mm. The blocks 10 and 12 may be joined by soldering. Two additional blocks of copper, not shown, approximately 3×3×3 mm can be attached by soldering, one on each end of the assembly. The copper blocks are used to attach fluid and electrical connectors, not shown. A groove approximately 0.1 mm deep and 0.05 mm wide is cut across the surface of all four blocks, and then covered with a thin adhesive polymer film, not shown, to form a closed fluid channel between inlet and outlet fluid connectors. With water flowing through the channel 20, a current of approximately two amps is applied so as to cool the junction between the two bismuth teluride blocks 10 and 12. Fluid flow through the valve may be stopped in less than a second. When the electric current is stopped, junction is heated by thermal conduction and fluid flow resumed in about five seconds. Active heating of the junction 14 may be used to rapidly heat the junction 14 and rapidly melt the plug 30 for increased speed of valve actuation.

Figure 2:
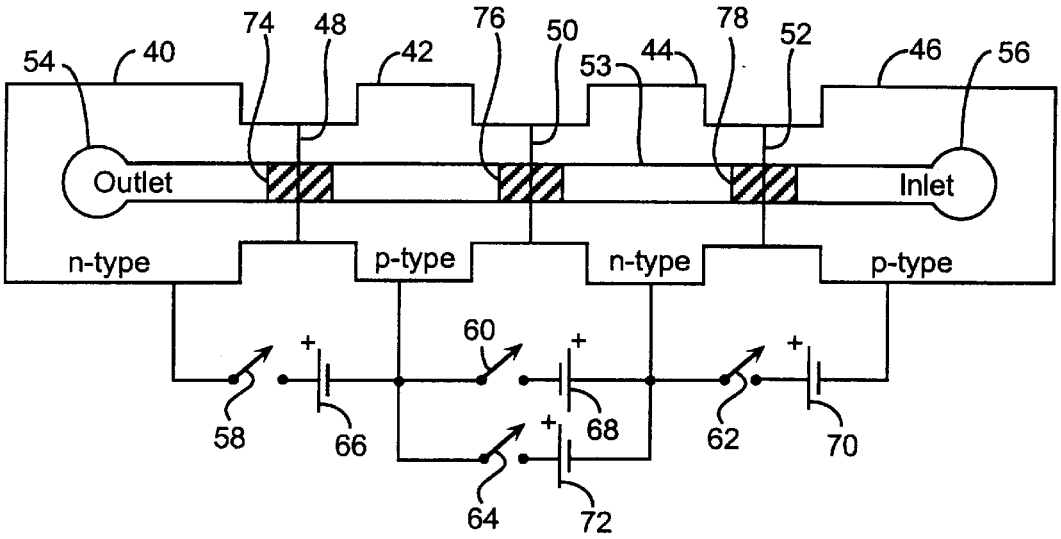
FIG. 2 is a pump switching schematic.

Referring to FIG. 2, a micromechanical pump comprises a plurality of valves between a plurality of alternating metal blocks, for example, three valves are formed by a series of four alternating metal blocks, n-type block 40, p-type block 42, n-type block 44, and p-type block 46. Blocks 40 and 42 form a first junction 48, blocks 42 and 44 form a second junction 50, and blocks 44 and 46 form a third junction 52 all having a common tube 53 for controlled pumping of the fluid in the fluid communicating tube 53 extending between an outlet 54 and an inlet 56. The first, second, and third junctions 48, 50, and 52, respectively, correspond to the first, second, and third valves.

The junctions 48, 50, and 52 can be selectively cooled or heated by connecting and controlling electrical contacts to selectively cool or heat fluid at the junctions. A plurality of switches 58, 60, 62 and 64, and respective sources of electrical currents, such as batteries 66, 68, 70 and 72, control the junctions 48, 50, and 52 to freeze or melt respective plugs 74, 76, and 78. The switches are controlled to induce a pumping action by heating to expand or cooling to contract fluid in the tube 53 at the second junction 50 while appropriately controlling the fluid action by freezing or melting plugs 74 and 78 at respective junctions 48 and 52, at differing times to facilitate the pumping action. The colling of the second junction 76 contracts fluid to draw fluid into the pump whereas heating of the second junction 76 expands fluid to force fluid out of the pump.

The switches 58, 60, 62, and 64 control the operation of the micromechanical pump. When switch 58 is closed, battery 66 conducts current through the switch 58, through the n-type block 40, through the junction 48 to the p-type block 42, and back to the battery 66 to cool. the first junction 48 to freeze the plug 74 in the tube 53 at the first junction 48. When switch 60 is closed, battery 68 conducts current through the n-type block 44, through the second junction 50 to the p-type block 42, through the switch 60, and back to the battery 68 to cool the second junction 50 to cool the fluid and perhaps to freeze the plug 76 in the tube 53 at the second junction 50. When switch 62 is closed, battery 70 conducts current through the switch 62, through the n-type block 44, through the third junction 52 to the p-type block 46, and back to the battery 70 to cool the third junction 52 to freeze the plug 76 in the tube 53 at the junction 74. When switch 64 is closed, battery 72 conducts current through the switch 64, through the p-type block 42, through the second junction 50 to the n-type block 44, and back to the battery 72 to heat the second junction 50 to melt the plug 76 in the tube 53 or to heat and thereby expand the fluid in the tube 53 at the junction 50. The use of active heating enables faster melting and greater temperature ranges and control over the fluid than allowing the plug 76 to melt due to thermal conduction through the blocks 40–44. Additional switches and batteries, not shown, could be used as well to rapidly heat junctions 48 and 52 to melt plugs 74 and 78, respectively.

Figure 3:
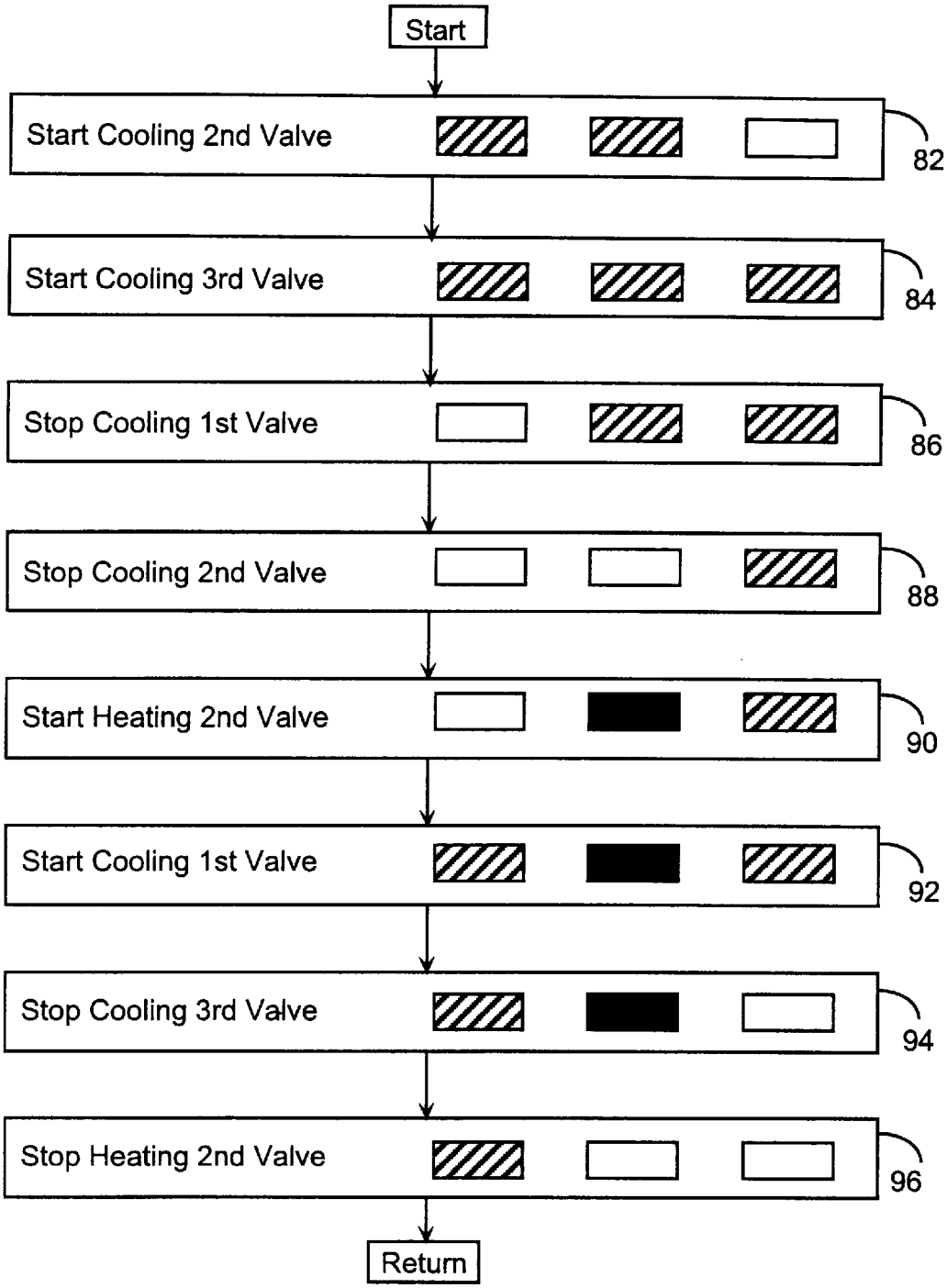
FIG. 3 is flow diagram of a micromechanical pumping method.

Referring to FIGS. 2 and 3, the preferred pumping method is applicable to the preferred first, second, and third valves corresponding to the respective first, second and third junctions 48, 50, and 52 for pumping fluid from the inlet 56 towards the outlet 54. The fluid within the tube 53 preferably has three discrete temperatures frozen, heated, and ambient. The ambient temperature of the fluid is obtained through passive thermal conduction without actively cooling or heating the three micromechanical valves by controlled current conduction through the respective junctions 48, 50, and 52. Intermediate temperatures could be used for controlled pumping, but the frozen, heated and ambient discrete temperatures are preferred to match the open and closed current conduction states of switches 58, 60, 62, and 64.

The pumping action is perfected by a plurality of pumping states 82–96. The initial pumping state 82 of an exemplar sequence has the first valve plugged by cooling the first junction 48 by closing switch 58 to freeze the fluid to form the plug 74 to stop the communication of the fluid in a static state. In step 82, the second valve is also cooled by closing switch 60 to cool the second junction 50 to form plug 76. As the second junction 50 cools, the fluid contracts creating a negative fluid pressure, drawing fluid through the third junction 52 from the inlet 56. In step 84, the third valve is plugged by cooling the third junction 52 by closing switch 62 to form plug 78. The third. valve is plugged 84 so as to prevent back flow of fluid towards inlet 56 and to also trap fluid between the first and third junctions 48 and 52. In step 86, the first valve is unplugged by opening switch 58 to stop the cooling of the first junction 48 so that the plug 74 melts by thermal conduction and allows for flow of fluid towards the outlet 54. Active heating of junction 48 could be used to rapidly melt plug 74. In step 88, the cooling of the second valve is stopped by opening switch 60. The fluid in the second valve is heated by thermal conduction through the blocks 40, 42, 44, and 46, and the resulting fluid expansion forces fluid through the first valve and out of outlet 54. In step 90, the second junction 50 is heated by closing switch 64 which heats the fluid in the tube 53 at the second junction 50. Optionally, step 88 may be skipped because the heating of the junction 50 in step 90 also serves to rapidly melt the plug 76. The heated fluid at the second junction 50 expands to provide increased fluid pressure for communicating the fluid through the first junction and towards the outlet 54. The third valve remains plugged preventing fluid flow towards the inlet 56. In both cases of stopping the cooling 88, and/or providing the heating 90, the temperature of the fluid rises, causing fluid expansion and creating fluid pressure towards the outlet 54. In the preferred form, active heating is used to expand the fluid to create increased fluid pressure. Heat may increase the effectiveness of the pump, but is not needed to create a minimum amount of fluid pressure, when the fluid in the second valve is heated only under thermal conduction through the blocks 40, 42, 44, and 46. In step 92, the first valve is plugged by closing switch 58 to prevent back flow from the outlet 64 through the first junction 48. In step 94, the third valve is unplugged by opening switch 62 so that the third plug 78 melts under thermal conduction. Active heating of junction 52 could be used to rapidly melt plug 78. In step 96, the second valve is no longer heated at the second junction 52 by opening the switch 64. As the temperature cools around the second junction 52, the fluid contracts creating a negative pressure around the second junction 52 to draw fluid from the inlet 56 towards the second junction 52. The process continues to repeat at step 82 when the second valve is again cooled at the second junction 50. The active cooling of the second junction 50 in step 82 also serves to contract the fluid to draw the fluid into the pump.

The pump has no moving parts subject to wear nor seals subject to leakage at the junctions 48, 50, and 52 used for freezing a plug of frozen fluid. The pumping action of the micromechanical pump depends upon plugging and unplugging the tube 53 with a plurality of frozen plugs created by a respective plurality of peltier junctions. The plugging is accomplished by cooling of the respective junctions to create respective frozen plugs. Melting of the plugs, and therefore the elevating of the fluid temperature may be provided in a number of ways. Thermal conduction through the blocks 40, 42, 44, and 46 may be sufficient depending on the application and pump efficiency desired. Active heating, such as by an external temperature controller may provide a source of heat for the thermal conduction. Optionally, any of the junctions may have switches and electrical supplies for providing reverse current through the junctions to heat the junctions to melt the respective plugs and/or to raise the temperature of the fluid at the respective junctions.

Step 86 for stopping the cooling of the first valve, step 88 for stopping the cooling of the second valve, and step 90 for heating the second valve, may all be performed simultaneously because the third valve remains plugged during steps 86, 88, and 90. Likewise, steps 94 for stopping the cooling of the third valve, step 96 for stopping the heating of the second valve, and step 82 for cooling the second valve, may all be performed simultaneously because the first valve remains plugged in steps 94, 96 and 82. Hence, the preferred method with second valve heating may be effectively reduced to three steps comprising the step 84 and 86, the step 88, 90 and 92, and the step 94, 96 and 82.

The preferred method relies on both freezing and unfreezing the first and third junctions, and heating and cooling of the fluid at the second junction. The second junction is primarily used for expanding the fluid during heating and contracting the fluid during cooling between the first and third junctions to create the positive and negative pumping pressures. However, both freezing and heating of the second junction are not required, but only preferred. That is, there must be a means to change the temperature of the fluid at the second junction. The temperature change can be equivalently achieved by active cooling and active heating, active cooling and passive thermal warming, or active heating and passive thermal cooling.

In the preferred form, the fluid at the valve is heated to expand and cooled to contract. In the case of particular fluids, such as water, freezing acts to expand the fluid and melting acts to contract the fuid. Hence, with particular fluids, freezing and melting at the second valve is equivalent to heating and cooling, respectively.

In the preferred form, the pump was configured using alternating blocks n-type 40, p-type 42, n-type 44 and p-type 46. However, a variety of arrangements are possible. For example, the pump could comprise three separate and distinct valves, each having a respective n-type and p-type block. The preferred form used four blocks to make three junctions, but six blocks could have been used instead. In the preferred form, the p-type block 42 is used for the first and second valve but could have been two connected p-type blocks, and, the n-type block 44 is used for the second and third valve, but also could have been two connected n-type blocks. Various configurations will enable certain cost effective reductions, such as the number of blocks, connections, batteries and switches, and all equivalent forms. Those skilled in the art can make enhancements, improvements and modifications to enhance the invention. However, those enhancements, improvements and modifications may nonetheless fall within the spirit and scope of the following claims.

What is claimed is:

1. A method of pumping a fluid in a pump comprising in order an inlet, a third valve, a second valve, a first valve, and an outlet, each valve is a peltier junction of an n-type material and p-type material, the first and third valves are for cooling the respective first and third junctions to freeze the fluid to form a fluid plug at the respective first and third junctions when current conducts from the n-type material to the p-type material, the second valve is for cooling and heating the fluid at the second junction between the first and third valves for respectively contracting and expanding the fluid at the second junction, the method comprising the steps of, cooling the second valve for drawing the fluid from the inlet to between the first and third valves, plugging the third valve for obstructing back flow communication of the fluid, unplugging the first valve for communicating the fluid from between the first and third valves towards the outlet, heating the second valve for forcing the fluid from between the first and third valves towards the outlet, plugging the first valve for obstructing back flow communication of the fluid, unplugging the third valve for communicating the fluid from the inlet to between the first and third valves, and repeating all the steps for pumping the fluid from the inlet toward the outlet.

2. The method of claim 1, wherein the second valve is actively heated by conducting reverse current from the p-type material to the n-type material of the second junction.

3. The method of claim 1, wherein the second valve is heated by passive thermal conduction of the n-type and p-type materials of the second junction.

4. The method of claim 1 wherein the first and third valves are unplugged by passive thermal conduction of the n-type and p-type materials of the respective first and third junctions.

5. The method of claim 1 wherein the first and third valves are unplugged by active heating of the junction by conducting reverse current respectively through the n-type and p-type materials of the first and third junctions.

6. The method of claim 1, wherein the fluid expands when frozen and contracts when melted, the heating step is replaced by a freezing step to freeze the fluid at the second junction, and the cooling step is replaced by a melting step to melt the fluid at the second junction.

* * * * *